United States Patent [19]

Price

[11] Patent Number: 4,981,180

[45] Date of Patent: Jan. 1, 1991

[54] POSITIVE LOCK OF A DRIVE ASSEMBLY

[75] Inventor: Herman P. Price, Gainesville, Tex.

[73] Assignee: National-Oilwell, Houston, Tex.

[21] Appl. No.: 379,765

[22] Filed: Jul. 14, 1989

[51] Int. Cl.[5] ..... E21B 3/00

[52] U.S. Cl. ..... 173/164

[58] Field of Search ..... 173/163, 164; 175/52, 175/85, 113

[56] References Cited

U.S. PATENT DOCUMENTS

| | | | |
|---|---|---|---|
| 3,901,330 | 8/1975 | Slator et al. | 173/57 |
| 3,964,552 | 6/1976 | Slator | 173/164 |
| 4,529,045 | 7/1985 | Boyadjiett et al. | 173/164 |
| 4,570,706 | 2/1986 | Pugnet | 166/77.5 |
| 4,605,077 | 9/1986 | Boyadjieff | 173/164 X |
| 4,660,634 | 4/1987 | Johnson, Jr. | 166/77.5 |
| 4,781,359 | 11/1988 | Matus | 267/71 |

*Primary Examiner*—Douglas D. Watts
*Assistant Examiner*—Willmon Fridie, Jr.
*Attorney, Agent, or Firm*—R. J. Bunyard; L. A. Fillnow; R. H. Johnson

[57] ABSTRACT

A positive lock for a drive assembly joint. In a top driven drilling machine, the motor for rotating the drill string is threadably connected to a drill pipe by the drive assembly. The lock eliminates the need for overtorquing and prevents loosening of the drive assembly joint when using the motor to break the connection between the drive assembly and the drill pipe. The lock also prevents tightening or damage to the joint during drilling. Costs and maintenance associated with an upper wrench are eliminated since the upper wrench is no longer required for making and breaking pipe connections.

12 Claims, 5 Drawing Sheets

POSITIVE LOCK OF A DRIVE ASSEMBLY

BACKGROUND OF THE INVENTION

This invention relates to a drive assembly for a top driven drilling machine. More particularly, the invention relates to a positive lock to prevent unwanted tightening or loosening of the drive assembly when using the drill motor to break the connection between the drive assembly and a drill string.

Conventional rotary drilling requires the use of a rotary table, a motor mounted on or below the rig floor for rotating the table, and a four or six sided kelly for rotationally connecting the table to the drill string. In recent years, these drilling machines are being replaced by or retrofitted with top driven drilling machines, otherwise known as power subs or power swivels, which rotate the drill string using a drilling motor suspended from a traveling block within a standard derrick or mast. The drilling motor is connected to the drill string for powered rotation by a cylindrical stem or drive assembly extending downwardly within the derrick from the drill motor. A cutting tool or bit is placed at the bottom end of the drill string which, through the rotational energy supplied by the drill motor, cuts through the earth's formations and deepens a well.

As the well is drilled, the bit becomes worn and periodically must be replaced. When replacement of the bit becomes necessary, a portion of the drill string corresponding in length to one or more sections of drill pipe must be removed from the well and pulled above the drill rig floor. This portion of the drill string, i.e., a stand of pipe, is removed and stored on the rig. The drill string is again pulled from the well exposing the next stand of pipe above the floor and this stand is similarly removed. This sequence, usually referred to as tripping out, is continued until the entire drill string is removed from the well. The bit on the bottom pipe section is replaced and the drill string is reassembled; i.e., tripping in, by connecting all the pipe sections previously removed.

When a drill string must be removed from a well, the driller operates a console on the rig floor causing a traveling block to elevate the drill string. The drill string is lifted until the bottom tool joint of the stand to be removed is just above the rig floor. Slips or wedges are then placed around the drill string and under the tool joint in the slip bowl for supporting the weight of the drill string. The stand is removed from the drill string by first disconnecting the upper end of the stand from the lower end of the drive assembly. With a conventional power swivel, a powered wrench, i.e., a make-break, is used to disconnect the stand. The make-break includes lower grabs for securing the upper end of the stand and an upper wrench for engaging the lower end of the drive assembly. The make-break rotates the upper wrench relative to the lower grabs to loosen the threaded connection therebetween. The upper wrench and lower grabs then must be disengaged and the drive assembly is rotated under the power of the drill motor to disengage the threaded connection, with whatever frictional drag remaining in the threads being reacted downwardly through the stand toward the rig floor. The bottom tool joint is then broken in a similar manner and unthreaded. The stand of pipe is then removed from the drill string and placed in a vertical storage rack.

Notable disadvantages when using an upper wrench to untorque and break the connection between the drill pipe and drive assembly are the added initial cost of equipment, additional maintenance during drilling, and more time required to break connections. It has been proposed to use the drill motor on top driven drilling machines to make and break connections between the drive assembly and the drill pipe. Unlike the kelly on conventional drilling units, the drive assembly for the top driven drilling machines may include one or more joints formed by an internal blow out preventer valve, a telescopic sub, a saver sub, and the like. Since tool joints and drive assembly joints are normally threaded in the same direction, any attempt to break the connection between the drive assembly and drill pipe using the drill motor can simultaneously cause untorquing or unthreading of the joints within the drive assembly, which should remain tight. To insure that only the proper joint breaks loose when using the top drive drill motor, drillers may tighten the remaining joints to 40% or more of the recommended makeup torque. This excessive loading may exceed the capacity of overtorqued joints. Joints may also become tightened during drilling if torsional shocks are present.

BRIEF SUMMARY OF THE INVENTION

The invention relates to a positive lock to prevent unwanted tightening or loosening of a joint in a drive assembly during rotation of a drill string by a power swivel or when disconnecting the power swivel from the drill string. The power swivel includes a motor threadably connected by the drive assembly to a drill pipe for powered rotation of the drill string. Means for locking the joint formed between the upper end of the drive assembly and the lower end of the motor is provided.

It is a principal object of this invention to prevent loosening of a drive assembly joint when breaking the connection between a drive assembly and a drill pipe and to prevent tightening of the drive assembly joint during drilling.

A feature of the invention is to provide means to torsionally restrain adjacent ends of the joint formed between a drive assembly and a power swivel.

Another feature of the invention is to provide means for axially restraining adjacent ends of the joint formed between a drive assembly and a power swivel.

Another feature of the invention is to provide a lock to torsionally restrain adjacent ends of the joint formed between a drive assembly and the drill motor drive stem of a power swivel.

Another feature of the invention is to mount a segmented lock on the adjacent ends of the joint formed between a valve in the drive assembly and the drill motor drive stem of a power swivel.

Another feature of the invention is to provide a drive assembly including a plurality of joints and mount a lock on the adjacent ends of each of the joints in the drive assembly and mount a lock on the adjacent ends of the joint formed between the drive assembly and the drill motor drive stem of a power swivel.

An advantage of the invention is to prevent overtorquing of drive assembly joints caused by vibration during drilling. Another advantage is elimination of the need to overtorque drive assembly joints to prevent unthreading or loosening when breaking the tool joint using the motor of a power swivel. Additional advantages of the invention include reduced initial cost and reduced maintenance costs because the upper wrench has been eliminated, reduced time to break pipe connections when using a drill motor, and stronger drive assembly joints because of the positive lock.

The above and other objects, features and advantages of the invention will become apparent upon consideration of the detailed description and appended drawings.

DETAILED DESCRIPTION OF THE PREFERRED EMBODIMENT

Figure 1:
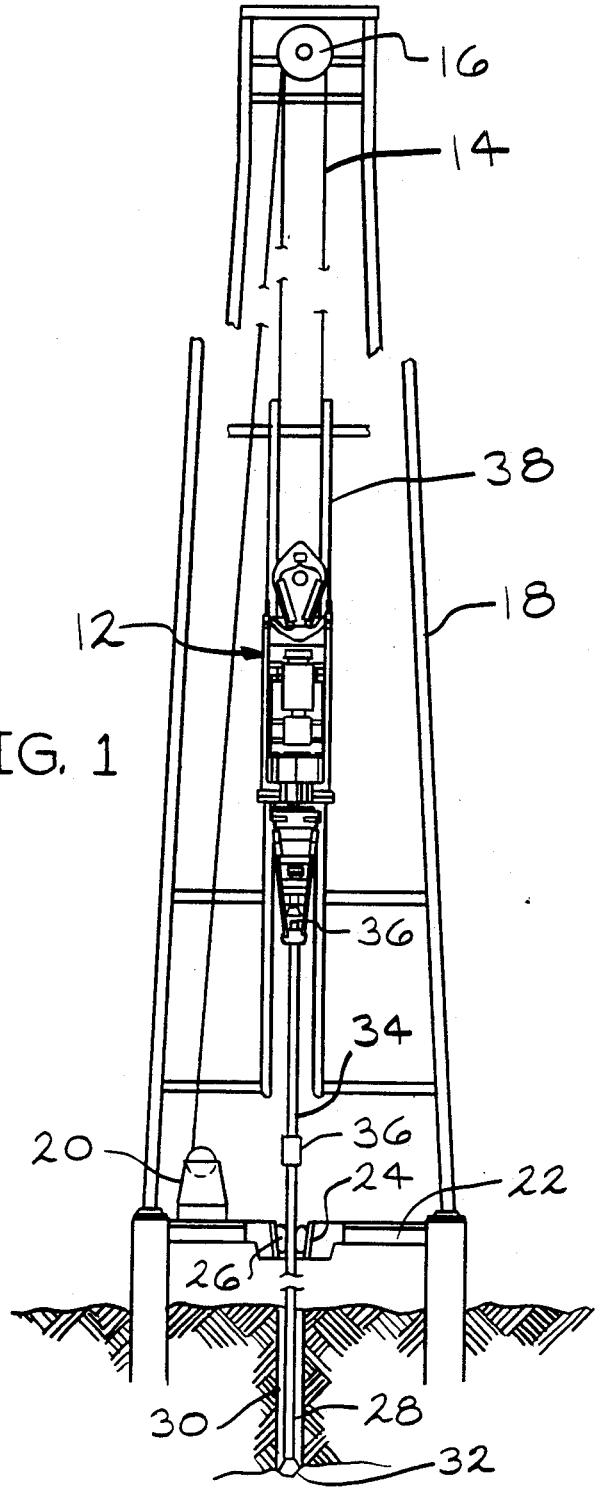
FIG. 1 is a schematic view of a top driven drilling machine incorporating the invention.

Referring to FIG. 1, reference numeral 12 denotes a top driven drilling machine or power sub, hereafter referred to as a power swivel, suspended from a crown block 16 within a derrick 18 by a rope 14 reeved over block 16 and around a drawworks 20. Derrick 18 includes a rig floor 22, a slip bowl 24 and slips 26. A drill string 28 is rotated into a well 30 by the cutting action of a drill bit 32 mounted at the bottom of drill string 28. Drill string 28 is connected to power swivel 12 through one or more stands of drill pipe 34 having tool joints 36. Power swivel 12 is remotely operated from a console (not shown) on rig floor 22 for simultaneous powered rotation of drill string 28 and vertical movement along a pair of guide tracks 38.

Figure 2:
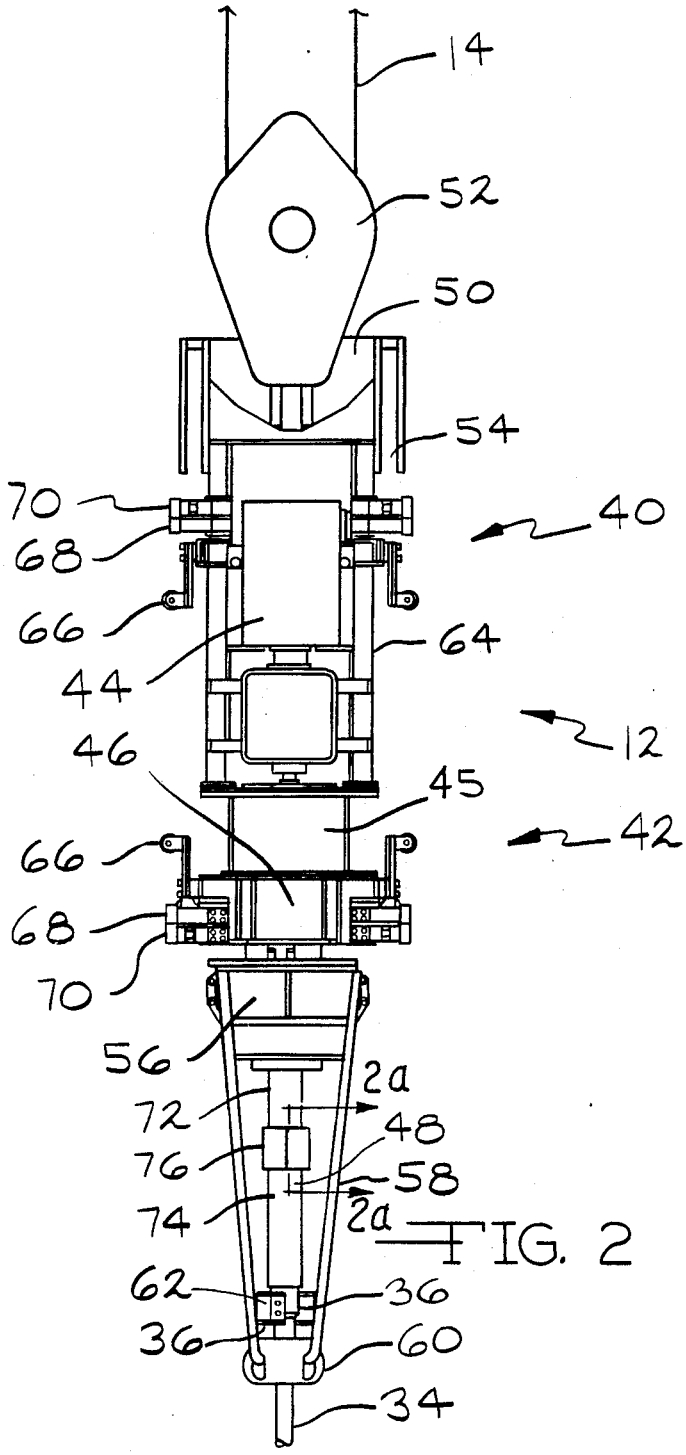
FIG. 2 is an elevation view, partially in section, of a motor assembly and a handling system of FIG. 1 with certain parts removed for the sake of clarity.
Figure 2A:
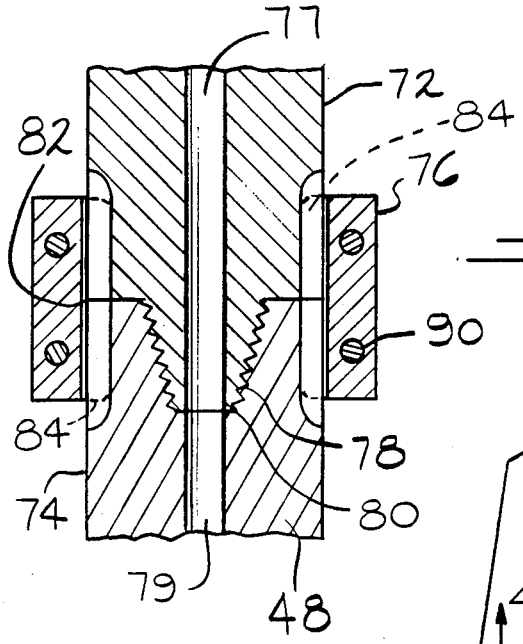
FIG. 2A is a longitudinal section view of one embodiment of a lock of the invention along line *2a—2a* in FIG. 2.
Figure 3:
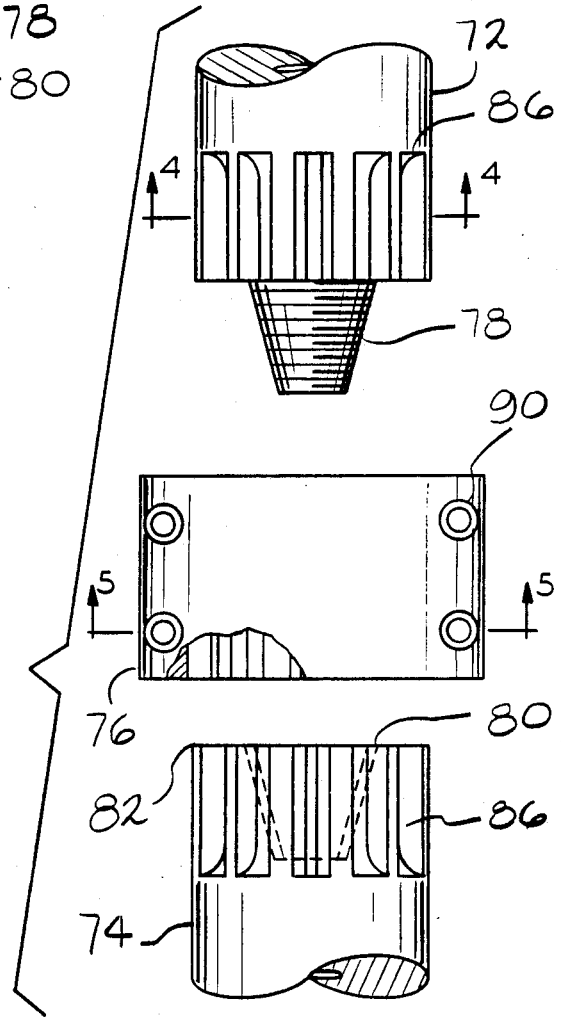
FIG. 3 is an exploded view of the drive assembly lock of FIG. 2A.
Figure 4:
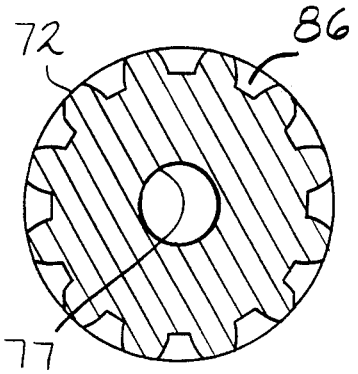
FIG. 4 is a cross section view along line 4—4 of the drive stem in FIG. 3.
Figure 5:
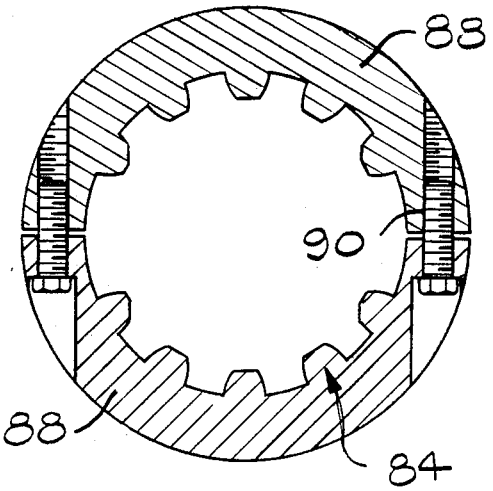
FIG. 5 is a cross section view along line 5—5 of the lock in FIG. 3.

FIG. 2 shows the components of power swivel 12, including a motor assembly 40 and a pipe handling system 42. Motor assembly 40 includes a motor 44, a gear box 45, a housing beam 46, and a drive stem 72. A drive assembly 48 connects drive stem 72 to drill pipe 34 for powered rotation of drill string 28 by motor 44. Handling system 42 includes a traveling beam 50 mounted at the bottom of a traveling block 52 for supporting a pair of main support links 54 (partially removed for clarity), a handling ring 56, a pair of elevator links 58 supported from handling ring 56 for supporting an elevator 60, and grabs 62. Housing beam 46 includes a thrust bearing (not shown) for supporting the weight of drill string 28 during drilling and a through-bore for receiving drive stem 72. Power swivel 12 is mounted onto a cart 64 for vertical movement within derrick 18 and guided by four sets of rollers 66, 68, 70, which engage guide tracks 38 (see FIG. 1).

FIGS. 2A and 3–5 show details of an embodiment of a locking mechanism 76 for joining the upper end of drive assembly 48 to the lower end of drive stem 72. Drive stem 72 includes a throughbore 77 and a threaded pin 78 for connection to a box 80 in a valve 74, e.g., an internal blow out preventer, having a throughbore 79. A joint 82 is formed by threading pin 78 of drive stem 72 until tightly seated in box 80. Of course, it will be understood drive assembly 48 could include one or more additional cylindrical members such as a telescopic sub, a packing sub, a saver sub, and the like, all of which are disclosed in U.S. Pat. No. 4,781,359, incorporated herein by reference. Inclusion of these members with drive assembly 48 would include additional joints similar to joint 82 with each joint requiring lock means 76. Lock means 76 for locking joint 82 preferably is segmented and may include a pair of clamps 88 (see FIG. 5) which are bored for receiving bolts 90. Of course, it will be understood locking means 76 could include more than two segments 88. The inside surface of each clamp 88 includes splines 84 for mating with grooves 86 on the outer surface of adjacent ends of drive stem 72 and valve 74. Lock 76 provides torsional restraint, thereby preventing relative rotation between drive stem 72 and valve 74 by mounting clamps 88 around joint 82 so that splines 84 are received within grooves 86.

Locking means 76 forms drive assembly 48 and drive stem 72 into an integral unit to not only prevent unthreading of joints 82 when breaking the connection between motor 44 and drill pipe 34 at tool joint 36 but also prevents overtorquing of joints 82 caused by vibration during drilling. In the process of drilling a well, there can be rotational shocks because the drill bit or a section of the drill string snag on a rock, ledge and the like. Rotational shock also occurs when the bit or drill string is released from the well obstruction. Without the locking means, the preload and associated stress stress on drive assembly joints would be increased and damage to drive assembly components caused by overtightening could result. Using locking means 76 to prevent unthreading of drive assembly joints 82 when breaking tool joint 36 eliminates the need for overtorquing joints 82 during makeup. By preventing overtightening, locking means 76 also allows motor 44 to be used to break the joint between the motor and the drive assembly thus eliminating the need for an upper wrench. Elimination of the upper wrench avoids the installation cost and maintenance cost of the wrench, reduces the weight of the power swivel assembly, and reduces operating cost since the rig time associated with operating the upper wrench is eliminated.

Figure 6:
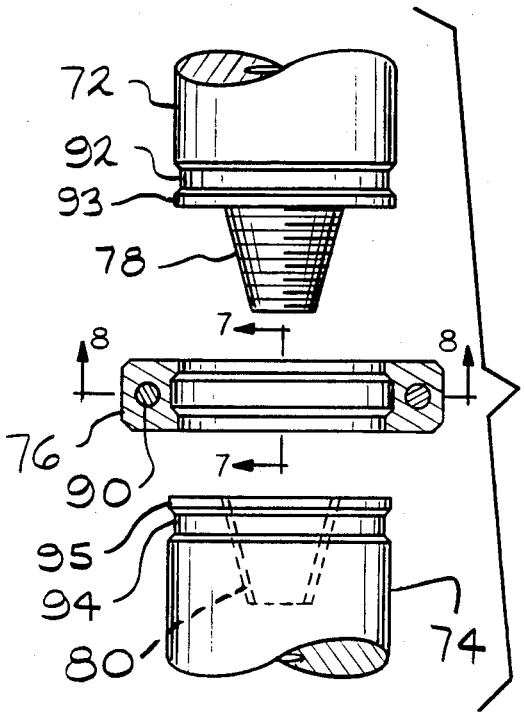
FIG. 6 is an exploded view of another embodiment of the drive assembly lock.
Figure 7:
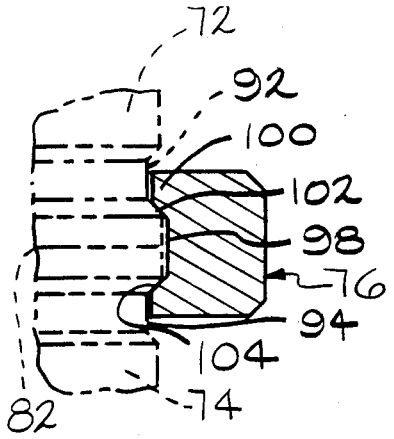
FIG. 7 is a longitudinal section view along line 7—7 of the lock in FIG. 6.
Figure 8:
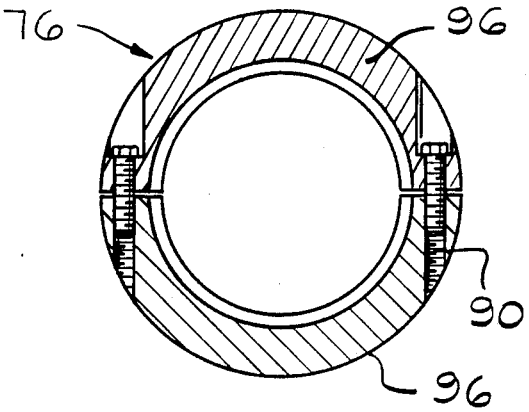
FIG. 8 is a cross section view along line 8—8 of the lock in FIG. 6.

FIGS. 6–8 show another embodiment of lock 76. Instead of splines, peripheral grooves 92, 94 are provided around adjacent ends of drive stem 72 and valve 74 respectively. Lock 76 could be formed by a pair of C-clamps 96 (see FIG. 8) having an inner recess 98 and lugs 100. As shown in FIGS. 6–8, the joint formed between drive stem 72 and valve 74 is locked by tightening flange 93 of drive stem 72 against flange 95 of valve 74. The wedging action of inclined surfaces 102 of clamps 96 against inclined surfaces 104 of flanges 93, 95 when bolts 90 are tightened locks joint 82 and provides axial as well as torsional restraint to joint 82. This axial reinforcement results in increased resistance of the threaded joint to bending stresses and an increased axial load rating.

Figure 9:
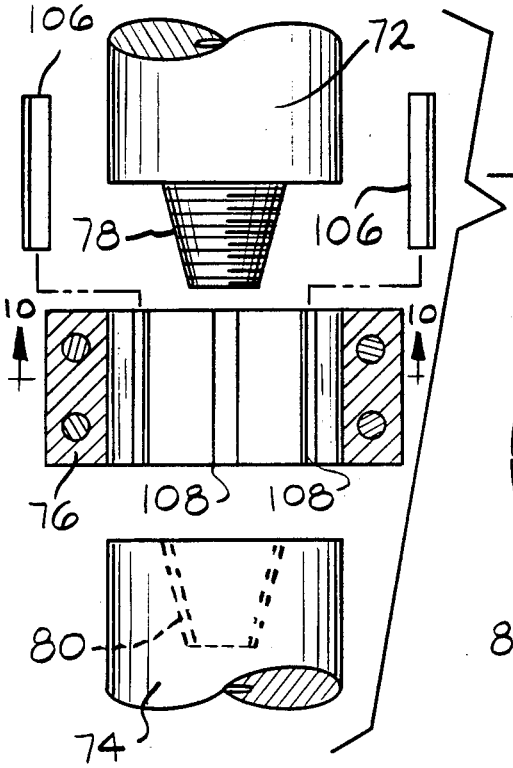
FIG. 9 is an exploded view of a further embodiment of the drive assembly lock.
Figure 10:
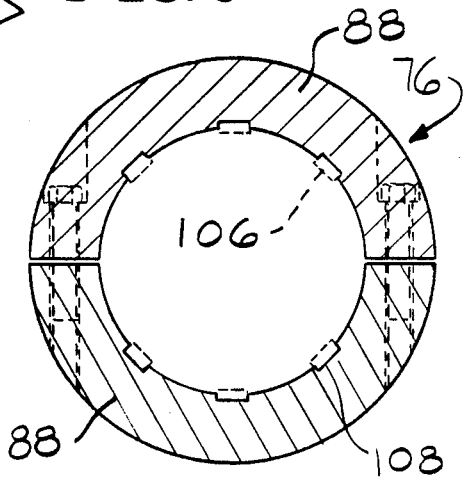
FIG. 10 is a cross section view along line 10—10 of the lock in FIG. 9.

FIGS. 9 and 10 illustrate a further embodiment similar to FIGS. 2A and 3–5 except splines 84 in clamps 88 have been replaced by die inserts 106 located in slots 108 and are gripped against the outer surface of drive stem 72 and valve 74.

Use of the invention will now be explained. When it becomes necessary to remove drill string 28 from well 30 such as to replace bit 32 or when adding an additional stand of pipe 34 to the top end of drill string 28, tool joint 36 between drive assembly 48 and pipe 34 must be broken (unthreaded). Should a stand be removed, the following sequence would take place. Drill string 28 is elevated using traveling block 52 and slips 26 are placed in bowl 24 for supporting the weight of drill string 28. Rotation of drill string 28 is prevented by securing pipe 34 with grabs 62 (FIG. 2). For conventional top driven drilling machines, drive assembly 48 now would be secured and rotated by a wrench. In the present invention, however, the direction of motor 44 is reversed (relative to the drilling direction) to break the joint and rotation is continued until drive assembly 48 is unthreaded from pipe 34. Any joints present in drive assembly 48, such as joint 82, will have the same thread direction as that in tool joint 36. Without lock 76, any joint 82 in drive assembly 48 would be exposed to an unthreading torque and possibly even become unthreaded as drive assembly 48 is rotated by motor 44 to break tool joint 36 connecting the bottom end of valve 74 to the top end of pipe 34. Rotation of motor 44 is continued until tool joint 36 is unthreaded. Stand of pipe 34 is loosened from drill string 28 by a torque wrench (not shown) on rig floor 22. A motor (not shown) on the rig floor is used to spin pipe 34 until tool joint 36 between drill string 28 and pipe 34 is unthreaded. Stand of pipe 34 is then placed in a storage rack. This sequence is repeated until drill string 28 is removed from well 30.

It will be understood, various modifications can be made to the invention without departing from the spirit and scope of it. For example, the lock can merely prevent relative rotation between adjacent ends of a drive assembly joint or the lock can be tightly mounted around the adjacent ends of the drive assembly joint to provide torsional restraint. When it is desirable to include means for protecting threaded connections against damage by impact, the drive assembly may include a plurality of joints, with each joint including a lock. Such protection means could include a telescopic or "cushioning" sub and an expendable saver sub. Therefore, the limits of the invention should be determined from the appended claims.

I claim:

1. The combination, comprising: a power swivel suspended for vertical movement within a derrick, said power swivel including a motor for rotation of a drill string into a well, a drive assembly for threadably connecting said motor to a drill pipe, the upper end of said drive assembly connected to the drive stem of said motor for forming a first joint in said drive assembly and the lower end of said drive assembly connected to said drill pipe, said drive assembly including a valve and a second joint, means for locking each of said joints to prevent tightening of said joints during drilling of said well by said motor and to prevent loosening of said joints when disconnecting said drive assembly from said drill pipe by said motor.

2. The power swivel of claim 1 wherein said locking means includes a plurality of segments.

3. The power swivel of claim 1 wherein said drive assembly further includes a telescoping member.

4. The power swivel of claim 1 wherein the inner surface of each of said locking means includes splines and the outer surfaces of the adjacent ends of each of said joints include grooves for receiving said splines.

5. The power swivel of claim 1 wherein the inner surface of said locking means includes die inserts.

6. The power swivel of claim 1 wherein the outer surfaces of the adjacent ends of said drive assembly and said drive stem include flanges, each of said flanges including inclining surfaces for mating with opposed surfaces on said locking means to provide axial restraint of said drive assembly relative to said drive stem.

7. The power swivel of claim 1 wherein the upper end of said valve is connected to said drive stem for forming said first joint.

8. The power swivel of claim 1 wherein said locking means provide axial restraint of said drive assembly relative to said drive stem.

9. The power swivel of claim 1 further including a handling system, said handling system including a handling ring for supporting an elevator, said handling ring being at a position above said joints whereby the load supported by said elevator is not supported by said joints.

10. The combination, comprising:

a power swivel suspended for vertical movement within a derrick, said power swivel including a motor assembly and a handling system, said motor assembly including a motor for rotation of a drill string into a well, said handling system including a handling ring for supporting an elevator, a drive assembly for threadably connecting said motor to a drill pipe, the upper end of said drive assembly connected to the drive stem of said motor for forming a first joint in said drive assembly and the lower end of said drive assembly threadably connected to said drill pipe, said drive assembly including a valve for forming a second joint in said drive assembly, said handling ring at a position above said joints whereby the load supported by said elevator is not supported by said joints, means for locking each of said joints to prevent tightening of said joints during drilling of said well by said motor and to prevent loosening of said joints when disconnecting said drive assembly from said drill pipe by said motor.

11. The power swivel of claim 10 wherein said locking means provides axial restraint of said drive assembly relative to said motor assembly.

12. The combination, comprising:

a power swivel suspended for vertical movement within a derrick, said power swivel including a motor for rotation of a drill string into a well and a handling system, said handling system including a handling ring for supporting an elevator, a drive assembly for threadably connecting said motor to a drill pipe, said drive assembly including a valve having threaded ends for forming first and second joints, the lower end of said drive assembly threadably connected to said drill pipe, the drive stem of said drill motor axially extending to a position below said handling ring, the upper end of said valve connected to said drive stem for forming said first joint, the lower end of said valve forming said second joint at a position above the connection between said drive assembly and said drill pipe, means for locking each of said joints to prevent tightening during drilling and to prevent loosening when disconnecting said drive assembly from said drill pipe by said motor.

* * * * *